United States Patent [19]

Tsuda et al.

[11] 4,247,344

[45] Jan. 27, 1981

[54] RUST PREVENTING TREATMENT OF METAL-PLATED STEEL MATERIALS

[75] Inventors: Seizo Tsuda, Tokyo; Eiichi Tarumi; Hironobu Kawaskai, both of Machida; Takashi Watanabe, Kanagawa, all of Japan

[73] Assignee: Nippon Steel Corporation, Tokyo, Japan

[21] Appl. No.: 45,659

[22] Filed: Jun. 5, 1979

Related U.S. Application Data

[63] Continuation of Ser. No. 884,846, Mar. 9, 1978, abandoned, which is a continuation of Ser. No. 730,973, Oct. 8, 1976, abandoned.

[30] Foreign Application Priority Data

Oct. 15, 1975 [JP] Japan ..... 50-123930
Oct. 15, 1975 [JP] Japan ..... 50-123931

[51] Int. Cl.³ ..... C23F 7/00
[52] U.S. Cl. ..... 148/6.14 R; 148/6.2
[58] Field of Search ..... 106/14.11–14.16; 148/6.14 R, 6.2

[56] References Cited

U.S. PATENT DOCUMENTS

| | | | |
|---|---|---|---|
| 3,968,313 | 7/1976 | Pearlman | 148/6.14 R |
| 3,975,214 | 8/1976 | Kulick et al. | 148/6.15 R |
| 4,039,353 | 8/1977 | Kulick et al. | 148/6.15 R |

FOREIGN PATENT DOCUMENTS

| | | | |
|---|---|---|---|
| 51-71233 | 6/1976 | Japan | 148/6.15 R |
| 7613966 | 12/1976 | Netherlands . | |

*Primary Examiner*—John D. Smith
*Attorney, Agent, or Firm*—Toren, McGeady and Stanger

[57] ABSTRACT

A rust preventing treatment for a metal-plated steel product which comprises treating the metal-plated steel product with an aqueous solution containing 0.01% to 10% by weight of tannic acid on the basis of the aqueous solution and 0.001% to 10% by weight of a water-soluble or water-dispersible polymer which is stable when mixed with the tannic acid to form a corrosion resistant film on the surface of the metal-plated steel product.

5 Claims, No Drawings

RUST PREVENTING TREATMENT OF METAL-PLATED STEEL MATERIALS

This is a continuation of application Ser. No. 884,846, filed on Mar. 9, 1978, now abandoned which, in turn, was a continuation of application Ser. No. 730,973, filed on Oct. 8, 1976, now abandoned.

BACKGROUND OF THE INVENTION

1. Field of the Invention

The present invention relates to rust preventing treatment of metal-plated steel material, such as zinc-plated, and zinc-alloy-plated steel materials.

2. Description of Prior Arts

Conventionally, chromate treatments have been widely used for rust prevention of metal materials, and various treating baths and methods have been developed for the chromate treatment. Basically these baths and methods are common and similar to each other in that they use chromic acid, dichromate or their salts.

Thus in the conventional chromate treating bath, there are present hexavalent chromium ions which react with the metal of the surface being treated to form the so-called chromate protective film and a film of hydrated compound of chromium oxide, entrapping the hexavalent chromium therein, which gradually dissolves in water to repair damaged surface portions. This is called "sealing action". Among various treatments, the chromate treatment has been most widely practised because it is very simple to perform and produces satisfactory corrosion resistance.

However, the chromate treatment has a problem of environment pollution in connection with the disposal of the used solution containing the hexavalent chromium which is effective component of the treating solution, and has defects that deterioration of the formed film is relatively rapid and adhesion with paint coating is not satisfactory.

Therefore, in recent years, strong demands have been made for developments of new surface treatments replacing the chromate treatment and overcoming the problems and defects confronted with by the chromate treatment.

The present inventors conducted various extensive studies for development of a new type of surface treatment of metal products, particularly metal-plated steel products, such as zinc-plated and zinc-alloy-plated, and steel products.

As a result, the present inventors developed a new surface treatment method using an aqueous solution of tannic acid as disclosed in Japanese Patent Publication No. Sho 51-2902.

According to this new treating method, not only paint-adhesion but also corrosion resistance of the metal-plated steel products can be improved by simple immersion in the treating solution just as in the chromate treating method. Further, the above new method has an advantage that disposal of the used solution is very easy because it does not contain heavy metals.

The present inventors have made further studies on rust preventing effect of the tannic acid on the metal, and found that particularly in case of zinc and its alloys, the tannic acid in an aqueous solution reacts with the metal very quickly and forms a film of aggregation polymer which hardly dissolves in water. This aggregation polymer film dissolves slightly and gradually in water in a similar manner to the gradual dissolution of the chromate film, and repairs the damaged surface portions, namely "sealing action", to produce disirable rust preventing effect.

However, when the aggregation polymer is exposed to water or an aqueous solution for a long time, the tannic acid component dissolves out of the film, and thus the film becomes no more effective to prevent rust. Further, the film is hard and brittle and, when formed in a thick film, it is very susceptible to cracking and peels off easily.

The present inventors have conducted various studies and experiments to overcome the above defects confronted with by the tannic acid treatment, and have found that the properties of the film can be remarkably improved by adding to the treating solution one or more of inorganic or organic, water-soluble or water-dispersible polymers which are stable when mixed with the tannic acid in the solution.

SUMMARY OF THE INVENTION

Therefore, one of the objects of the present invention is to provide a method for surface treatment of metal-plated steel products, such as zinc-plated and zinc-alloy-plated steel products, which method comprises treating the metal-plated steel products with an aqueous solution containing 0.01% to 10% by weight, preferably 0.5% to 5.0% by weight of tannic acid and 0.001% to 10% by weight, preferably 0.01% to 1.0% by weight of one or more of water-soluble or water-dispersible polymers which are stable when mixed with the tannic acid, and forming a corrosion resistant film on the surface of the metal-plated steel product.

DETAILED DESCRIPTION OF THE INVENTION

According to the present invention, when the surface of the metal-plated steel product is treated with the solution containing tannic acid and one or more of the water-soluble or water-dispersible polymers, the polymers form a net-work structure of long moleculars and produce a water-insoluble or hardly water-soluble film entangling the tannic acid.

This film provides a carrier for the tannic acid by catching and fixing it therein to improve the adhesion of the film and prevents the tannic acid from dissolving from the film when immersed in water for a long time. Thus, the film formed by the present invention can maintain the rust preventing effect for a longer time as compared with the film formed by the tannic acid straight solution.

The film formed by the present invention is water-insoluble in most cases, and if the film is not completely water-insoluble, the film may be made water-insoluble by heating treatments, such as baking after drying.

When an inorganic polymer is used as the polymer defined in the present invention, the inorganic polymer is converted by drying into a glassy substance to form a dense film, so that the film provides a high resistance against the permeation of air and water which promote the corrosion of the metal. Thus improving the corrosion resistance of the metal-plated steel product.

On the other hand, when the polymer used in the present invention is an organic polymer, the film thus formed is less resistive against the permeation of air and water than the film formed with the inorganic polymer addition, but provides better workability because the film is softer. Therefore, depending on the final application of the metal-plated steel products treated by the present invention, the film may be formed by selecting the inorganic polymers or the organic polymers.

Addition of inorganic polymer or polymers alone is satisfactory when the metal-plated steel product treated by the present invention is not subjected to subsequent workings, and addition of organic polymer or polymers alone is satisfactory when the metal-plated steel product is subjected to painting and workings. However, excellent corrosion resistance and workability can be assured when both inorganic polymer or polymers and the organic polymer or polymers are added to the treating solution.

The present invention is effective especially for surface treatment of zinc-plated, zinc-alloy-plated, and multiple-plated steel products.

The water-soluble or water-dispersible inorganic polymer used in the present invention which should be stable when mixed or in contact with the tannic acid, includes biphosphates of metals such as aluminum biphosphate, and magnesium biphosphate; metal silicates, such as water glass, partially hydrated compounds of alkyl silicate; and metal oxide sols, such as silica sol.

Also the water-soluble or water-dispersible organic polymer used in the present invention which should be stable when mixed or in contact with the tannic acid includes starch, polyvinyl pyrrolidonne polyacrylamides, polyacrylic acids, sodium alginate, polyacrylic acid esters and polyvinyl acetate.

As mentioned hereinbefore, the polymers used in the present invention are stable when mixed or in contact with the tannic acid. This means that the polymers, when mixed or in contact with the tannic acid do not precipitate and maintains a uniform state (aqueous solution or aqueous dispersion) for a long time, and this condition is satisfied by the polymers set forth above.

It is advantageous to select one or more among the polymers set forth above from the point of the stability of the treating solution so as to give an excellent surface to the treated products.

The tannic acid used in the present invention has a complicated structure basically composed of polyoxyphenyl group, and crude tannic acid is called tannine. Therefore, the term "tannic acid" includes tannine. Meanwhile polyoxyphenyl compounds, particularly those having three or more OH radicals in the molecular structure shows similar effects as the tannic acid, although the tannic acid and tannine are useful in the present invention.

According to the present invention, it is necessary that the concentration of the tannic acid in the treating solution is not less than 0.01%, and below this concentration satisfactory improvement of the corrosion resistance can not be attained.

On the other hand, the upper limit of the concentration of the tannic acid is determined from a practical point of view and not more than 10% is satisfactory. A preferable range of the tannic acid concentration is from 0.5% to 5.0% by weight on the basis of the solution.

As for the concentration of the water-soluble or water-dispersible inorganic polymers, not less than 0.001% is required for each or for two or more of the polymers in combination.

Below this concentration, corrosion resistance of the metal-plated steel product after the treatment is not satisfactory. On the other hand, the upper limit of the inorganic polymers is determined from a practical point of view, and not more than 10% by weight is enough. In case of the water-soluble or water-dispersible organic polymers, not less than 0.001% concentration for each or two or more of the polymers in combination is necessary. Below this concentration, corrosion resistance of the worked portions of the treated steel products is not satisfactory and no satisfactory resistance against the deterioration of the film is obtained. Meanwhile, from a practical point of view, the upper limit is set at about 10% by weight. Also a preferable range is from 0.5% to 5.0% by weight.

According to the present invention, the treating solution may be applied to the metal-plated steel products by various means, such as coating, spraying, and immersion, and the steel products thus treated are dried to complete the treatment. If necessary, squeezing may be done before the drying.

Thus the treatment according to the present invention can be done very easily just as the conventional chromate treatment, and can be applied to various forms of the steel products including plates, sheets, wires, tubes and press formed products.

In addition to the advantages set forth above, the present invention has an advantage that the steel products treated by the present invention show excellent paint adhesion, and thus provide satisfactory steel substrates for paint coating.

Also the present invention can be applied to various chemically converted steel products.

The present invention will be understood more clearly from the following preferred embodiments.

DESCRIPTION OF PREFERRED EMBODIMENTS

Example 1

A steel wire of 3 mm diameter coated with 300 g/m$^2$ zinc by dipping was treated in various aqueous solutions containing tannic acid and a water-soluble inorganic polymer for three seconds, dried, and subjected to the wet corrosion test (MIL STD 202 C) to determine resistance against white rust. The test was done after storing the test pieces in a room at 20° C. with 75% humidity for one month. Treating conditions and test results are shown in Table 1.

It is clearly demonstrated by the test results that the steel products, treated with the solution containing 0.01% to 10% by weight of tannic acid and 0.001% to 10% by weight of a water-soluble inorganic polymer show excellent corrosion resistance.

Table 1

| | Treating Solution | Wet Corrosion Test (200 hours) |
|---|---|---|
| | Non-treated | XX |
| Comparison | Tannic acid 0.005% + Aluminum biphosphate 1% | XX |
| | Tannic acid 0.02% | X |
| | Tannic acid o.o2% + Aluminum biphosphate o.1% | Δ |
| | Tannic acid 3% + Aluminum biphosphate 0.1% | ◎ |
| Present Invention | Tannic acid 5% + Potassium silicate 0.05% | O - ◎ |
| | Tannic acid 2% + Potassium silicate 0.01% | O - ◎ |

◎:No rust; 0: White rust not more than 3%;
Δ:White rust 4 to 9%; X:White rust 10 - 50%;
XX: White rust 51% or more
(%: percent of the rusted dimension to the total dimension tested)

Example 2

A cold rolled steel sheet of 0.8 mm thickness, coated with 10 g/m$^2$ 50Zn-50Al alloy was immersed in various aqueous solutions containing tannic acid shown in Table 2 for 5 seconds, and dried. Test pieces thus prepared were stored in a room at 20° C. with 75% humidity, and extruded 4 mm by an Erichsen test machine and subjected to a salt spray test (JIS Z-2371). Treating conditions and test results are shown in Table 2.

The test results reveal clearly that the treatments of the present invention give better corrosion resistance than those given by the comparison treatments.

Example 3

A steel sheet of 0.4 mm thickness coated with 70 g/m$^2$ zinc was treated in various treating solutions containing tannic acid as shown in Table 3 for five seconds and dried, and test pieces thus prepared were left in a room at 20° C. with 75% humidity for one month and subjected to wet corrosion test (MIL STD 202C) to determine resistance against white rust. The test pieces were extruded 4 mm by an Erichsen test machine and white rust formation on the extruded portion was measured. Treating conditions and test results are shown in Table 3.

It is clear from the results, the treatments according to the present invention give better corrosion resistance than those obtained by the comparison treatments.

Table 2

| | Treating Solution | Salt Spray Test (200 hours) |
|---|---|---|
| Com- | Aluminum biphosphate 2% | X X |
| pari | Tannic acid 0.005% + Aluminum biphosphate 2% | X X |
| son | Tannic acid 2% | Δ |
| Present | Tannic acid 4% + Starch 0.1% + Aluminum biphosphate 0.05% | ◎ - O |
| Inven- | Tannic acid 2% + Polyacryl acid ester* 0.5% + Silica sol* 0.1% | ◎ |
| tion | Tannic acid 2% + Sodium alginate 0.1% + Litium silicate 0.1% | O |

*per cent as solid components in emulsion Estimation is same as in Table 1

Table 3

| | Treating Solution | Wet Corrosion Test (200 hours) |
|---|---|---|
| Com- | Non-treated | X X |
| pari- | Tannic acid 5% | X - Δ |
| son | Tannic acid 2% + Silica sol 0.1% | Δ -O |
| | Tannic acid 2% + Polyacrylic acid ester 0.5% | Δ - O |
| Present | Tannic acid 2% + Silica sol 0.1% + Polyacrylic acid | |
| Inven- | ester 0.1% | O - ◎ |
| tion | Tannic acid 4% + Starch 0.1% + Magnesium biphosphate 0.1% | ◎ |
| | Tannic acid 1% + Polyacrylic amid 0.1% + Partially hydrated compound of ethyl silicate * 0.2% | ◎ |

* Aqueous solution obtained by partially hydrating ethyl silicate from hydrochloric acid; per cent as ethyl silicate before hydrolisis

What is claimed is:

1. A rust preventing treatment for zinc-plated and zinc-alloy-plated steel products which comprises treating the zinc-plated and zinc-alloy-plated steel products with an aqueous solution containing 0.01% to 10% by weight of tannic acid on the basis of the aqueous solution and 0.001% to 10% by weight of a water soluble or water dispersible polymer selected from the group consisting of aluminum bisphosphate, magnesium biphosphate, polyvinyl pyrrolidones, polyacrylamides, polyacrylic acids, sodium alginate, polyacrylic acid esters and polyvinyl acetates, which are stable when mixed with the tannic acid, to form a corrosion resistant film on the surface of the zinc-plated and zinc-alloy-plated steel products.

2. A rust preventing treatment according to claim 1, in which the aqueous solution contains 0.5% to 5.0% by weight of tannic acid.

3. A rust preventing treatment according to claim 1, wherein the aqueous solution contains 0.01% to 1.0% of the polymer.

4. A rust preventing treatment according to claim 1, wherein the metal-plated steel product is a zinc-plated steel product.

5. A rust preventing treatment according to claim 1, in which the metal-plated steel product is a zinc-alloy-plated steel product.

* * * * *